United States Patent [19]

Ito

[11] Patent Number: 4,819,029

[45] Date of Patent: Apr. 4, 1989

[54] COPYING MACHINE CAPABLE OF PRODUCING A COPY WITH A FILING MARGIN

[75] Inventor: Hideo Ito, Toyokawa, Japan

[73] Assignee: Minolta Camera Kabushiki Kaisha, Osaka, Japan

[21] Appl. No.: 138,724

[22] Filed: Dec. 23, 1987

Related U.S. Application Data

[63] Continuation of Ser. No. 007,960, Jan. 28, 1987.

[30] Foreign Application Priority Data

Jan. 29, 1986 [JP] Japan ..... 61-17400
Jan. 29, 1986 [JP] Japan ..... 61-17401
Jan. 29, 1986 [JP] Japan ..... 61-17402

[51] Int. Cl.[4] ..... G03G 15/00

[52] U.S. Cl. ..... 355/7; 355/3 R; 355/14 R; 355/55

[58] Field of Search ..... 355/3 R, 14 R, 8, 55, 355/56, 14 SH, 7

[56] References Cited

U.S. PATENT DOCUMENTS 4,187,024 2/1980 Satomi et al. ..... 355/14 R
4,386,769 6/1983 Ito et al. ..... 271/9
4,455,081 6/1984 Yoshimura et al. ..... 355/14 SH
4,501,490 2/1985 Miyamoto et al. ..... 355/55
4,505,574 3/1985 Kurata et al. ..... 355/14 R X
4,505,579 3/1985 Furuichi ..... 355/55
4,563,079 1/1986 Inuzuka et al. ..... 355/8
4,573,787 3/1986 Sanbayashi et al. ..... 355/55 X
4,582,418 4/1986 Kozuka et al. ..... 355/55 X
4,641,954 2/1987 Miyata et al. ..... 355/14 R
4,669,858 6/1987 Ito et al. ..... 355/8

*Primary Examiner*—A. C. Prescott
*Attorney, Agent, or Firm*—Price, Gess & Ubell

[57] ABSTRACT

A copying machine capable of producing a copy with a correct filing margin regardless of whether the document is single-sided or double-sided and whether the images are copied on both the sides of a copying paper or one side of the copying paper. The copying machine comprises: a glass platen for supporting a document; an image forming device for forming on a copying paper an image of the document, including a magnification varying device and an image shift device for shifting a transfer position of the image of the document on a copying paper with respect to the direction of conveyance of the copying paper; a mode selecting device for selecting one of a filing margin adjusting mode in which a filing margin is formed by the image shift device, a variable magnification shift mode in which a filing margin is formed by the image shift device and by the magnification varying device with reduced magnification, and a nonshift mode in which no filing margin is formed; and a control device for controlling the image forming device in accordance with a type of a document, a type of a copying paper, and the mode selected by the mode selecting device.

13 Claims, 15 Drawing Sheets

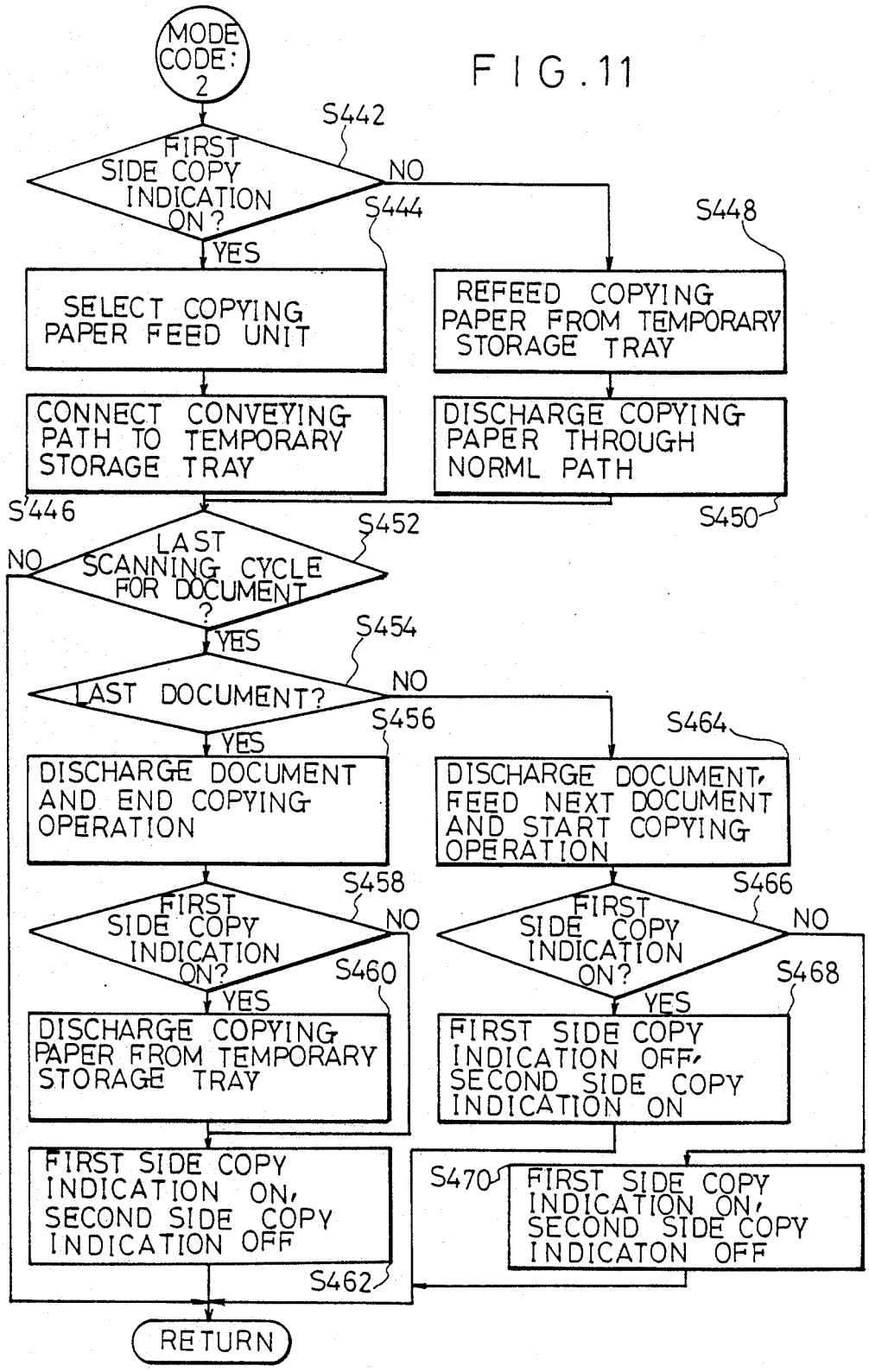
MODE CODE: 2
FIG. 11
S442
FIRST SIDE COPY INDICATION ON?
NO
YES
S444
SELECT COPYING PAPER FEED UNIT
CONNECT CONVEYING PATH TO TEMPORARY STORAGE TRAY
S446
S448
REFEED COPYING PAPER FROM TEMPORARY STORAGE TRAY
DISCHARGE COPYING PAPER THROUGH NORML PATH
S450
S452
LAST SCANNING CYCLE FOR DOCUMENT ?
NO
YES
S454
LAST DOCUMENT?
NO
YES
S456
DISCHARGE DOCUMENT AND END COPYING OPERATION
S458
FIRST SIDE COPY INDICATION ON?
NO
YES
S460
DISCHARGE COPYING PAPER FROM TEMPORARY STORAGE TRAY
FIRST SIDE COPY INDICATION ON, SECOND SIDE COPY INDICATION OFF
S462
S464
DISCHARGE DOCUMENT, FEED NEXT DOCUMENT AND START COPYING OPERATION
S466
FIRST SIDE COPY INDICATION ON?
NO
YES
S468
FIRST SIDE COPY INDICATION OFF, SECOND SIDE COPY INDICATION ON
S470
FIRST SIDE COPY INDICATION ON, SECOND SIDE COPY INDICATON OFF
RETURN

COPYING MACHINE CAPABLE OF PRODUCING A COPY WITH A FILING MARGIN

This is a continuation of application serial No. 007,960 filed on Jan. 28, 1987.

BACKGROUND OF THE INVENTION

1. Field of the Invention

The present invention relates to a copying machine, and, more specifically, to a copying machine being capable of reliably copying an image formed on a document on a copying paper with a filing margin therein through a simple operation in copying an image formed on a single-sided document on a copying paper, in copying images each formed on one side of two single-sided documents on both the sides of a copyiny paper, respectively, in copying images formed on both the side of a double-sided document on one side of each of two copying papers, respectively, or in copying images formed on both the sides of a double-sided document on both the sides of a single copying paper, respectively.

2. Discussion of the Background

In operating a copying machine, there are four types of copying. Namely, (1) single-sided document single-side copying in which an image formed on a single-sided document is copied on one side of a copying paper, (2) single-sided document double-side copying in which images each formed on one side of each of two single-sided documents are copied on both the sides of a single copying paper, (3) double-sided document single-side copying in which images formed on both the sides of a double-sided document are copied on one side of each of two copying paper, or (4) double-sided document double-side copying in which images formed on both the sides of a double-sided document are copied on both the side of a single copying paper.

A copying machine capable of having a filing margin adjusting mode or a variable magnification shift mode has also been proposed. The filing margin adjusting mode is the mode in which, in copying an image formed on a document with a certain margin, the image transfer position on a copying paper is shifted in the direction of conveyance of the copying paper by means of exposure scanning time adjusting means or copying paper feed timing adjusting means, thereby providing a copy having a filing margin in the opposite with reference to the certain margin of the document.

On the other hand, the variable magnification shift mode is the mode in which, in copying an image formed on the document without a certain margin, the image is reduced in size by varying the copying magnification and also the image transfer position on the copying paper is shifted in the direction of conveyance of the copying paper, thereby providing a copy having a filing margin.

(PROBLEM TO BE SOLVED BY THE INVENTION)

In producing a copy having a filing margin in one of the above-mentioned four types of copying by use of the filing margin adjusting mode or the variable magnification shift mode, sometimes, the following faulty copying operation occurs.

First, in copying image formed on a double-sided document having a filing margin in one edge on one side of each of two separate copying papers in the double-sided document single-side copying, an image formed on one side of the double-sided document is copied on a copying paper with a filing margin in one edge of the same, while an image formed on the other side of the double-sided document is copied on another copying paper with a filing margin in the opposite edge with reference to the edge of the former copying paper, therefore the resepective filing margins of the copying paper are unavailable.

Secondly, in copying images formed on a document having a filing margin in the single-sided document single-side copying, the images need to be copies as is through the normal copying operation without forming any particular mode is incorporated inadvertently into the copying operation, an unnecessary additional filing margin is formed in the copy and a portion of the image corresponding to the additional filing margin will not be copies in the copying area on a copying paper.

Thirdly, an unavailable filing margin is formed in copying a first image and a second image formed over the respective entire areas of two single-sided documents without any filing margin, or over the entire area of a double-sided document without any filing margin, in the single-sided document double-side copying or in the double-sided document double-side copying, respectively.

When the double-side copying operation is executed in the conventional variable magnification shift mode, filing margins are formed in one edge of one side of the copying paper and in the opposite edge of the other side of the copying paper, and hence these filing margins are unavailable.

SUMMARY OF THE INVENTION

Accordingly, the present invention has been made in view of the foregoing problems of the conventional copying machines. It is an object of the present invention to provide a copying machine capable of successfully producing a copy having correct filing margins through a simple operation, when the filing margin adjusting mode or the variable magnification shift mode is incorporated into any one of the above-mentioned four types of copying.

(MEANS FOR SOLVING THE PROBLEM)

According to one aspect of the present invention, a copying machine capable of producing a copy with a filing margin comprises:

a glass platen for supporting a document to be copied;

an image forming means for forming on a copying paper an image of the document placed on said glass platen, including a magnification varying means for varying magnification for projecting the image on the document to the copying paper, and an image shift means for shifting a transfer position of the image of the document on a copying ppaer with respect to the direction of conveyance of the copying paper;

a mode selecting means for selecting one of a filing margin adjusting mode in which a filing margin is formed by said image shift means, a variable magnification shift mode in which a filing margin is formed by said image shift means and by said magnification varying means with reduced magnification, and a nonshift mode in which no filing margin is formed; and a control means for controlling said image forming means in accordance with a type of a document, a type of a copying paper, and the mode selected by said mode selecting means.

According to another aspect of the present invention, a copying machine capable of producing a copy with a filing margin comprises:

a glass platen for supporting a document to be copied;

a document conveying means which conveys a single-sided document having an image on one side thereof or each side of a double-sided document having images on both the sides thereof to be in contact with said glass platen sequentially;

an image forming means for forming on a copying paper an image of the document placed in contact with said glass platen by said document conveying means, which includes an image shift means for shifting a transfer position of the image of the document on a copying paper to form a filing margin on a marginal side of the copying paper;

a mode selecting means for selecting one of a plurality of modes including a filing margin adjusting mode in which a filing margin is formed, a nonshift mode in which no filing margin is formed; and a control means for controlling said image forming means in accordance with the mode selected by said mode selecting means, in the case where a double-sided document is conveyed by said document conveying means, the filing margin adjusting mode is selected, and a first side of the double-sided document is to be copies, said control means controlling said image forming means to form no filing margin regardless of the selection of the filing margin adjusting mode.

According to a further aspect of the present invention, a copying machine capable of producing a copy with a filing margin comprises:

a glass platen for supporting a document to be copied;

an image forming means for forming on a copying paper an image of the document placed on said glass platen, including a magnification varying means for varying magnification for projecting the image on the document to the copying paper, and an image shift means for shifting a transfer position of the image of the document to form a filing margin on a predetermined marginal side of the copying paper, a duplex means for inverting a copying paper which has a copied image on a first side and re-supplying the copying paper to said image forming means;

a mode selecting means for selecting one of a plurality of modes including a variable magnification shift mode in which the image transfer position is shifted by said image shift means and the projecting magnification is reduced by said magnification varying means, and a nonshift mode in which no filing mode is formed;

a control means for controlling said image forming means in accordance with the mode selected by said mode selecting means, in the case where the variable magnification shift mode is selected and each of both the sides of a double-sided document is to be copied by using said duplex means, said control menas controlling said image forming means so that a filing margin is formed on a predetermined marginal side in copying a first side of the double-sided document and a filing margin is formed on the opposite side to the predetermined marginal side in copying a second side of the double-sided document.

According to a still further aspect of the present invention, a copying machine capable of producing a copy with a filing margin comprises:

a glass platen for supporting a document to be copied;

a document conveying means which conveys a single-sided document having an image on one side thereof or each side of a double-sided document having images on both the sides thereof to be in contact with said glass platen sequentially;

an image forming means for forming on a copying paper an image of the document placed on said glass platen, including a magnification varying means for varying magnification for projecting the image of the document to the copying paper, and an image shift means for shifting a transfer position of the image of the document to form a filing margin on a marginal side of the copying paper;

a duplex means for inverting a copying paper which has a copied image on a first side and re-supplying the inverted copying paper to said image forming means;

a first mode selecting means for selecting one of a single-sided document single-side copying mode in which an image on one side of a document is copied on one side of a copying paper, a single-sided document double-side copying mode in which images on one side of each of two single-sided documents, respectively, are copied on both the sides of a copying paper, a double-sided document single-side copying mode in which images on both the sides of a double-sided document, respectively, are copied on one side of each of two copying papers, and a double-sided document double-side copying mode in which images on both the sides of a double-sided document, respectively, are copied on both the sides of a copying paper, respectively.

a second mode selecting means for selecting one of a filing margin adjusting mode in which a filing margin is formed by said image shift means, a variable magnification shift mode in which a filing margin is formed by said image shift means and the magnification for projecting the image of the document is reduced in size so that the image of the document is copied in the remaining space except the filing margin, and a nonshift mode in which no filing margin is formed; and a control means for controlling said image forming means in accordance with the combination of the modes selected by said first mode selecting means and said second mode selecting means.

The requirements of the present invention will be described hereinafter.

(1) Image forming means

A conventional copying mechanism may be employed as the image forming unit. The image forming unit carries out a predetermined copying operation.

(2) Image shift means

The image shift means provides a filing margin to a copy by shifting the image transfer position. The filing margin shift can be achieved by a conventional method among: (i) a method of varying the copying paper feed motion starting time by a predetermined time measured by a timer, (ii) a method of varying the document feed motion starting time by a predetermined time measured by a timer, (iii) a method of shifting the position of an electrostatic latent image relative to a normal position on the photosensitive member by shifting the position of the optical system for optically scanning the document, at the exposure scanning starting time, and (iv) a method of shifting a document on the glass platen from a normal position.

(3) Magnification varying means

The conventional magnification varying means can be employed for the magnification varying means.

(4) Filing margin adjusting modé

The conventional filing margin adjusting mode can be used for the filing margin adjusting mode in the present invention.

(5) Variable magnification shift mode

The conventional variable magnification shift mode can be used for the variable magnification shift mode in the present invention.

(6) Control means

A microcomputer may be employed as the control means for controlling the copying machine.

(7) Document conveying means (Auto-reverse document feeder)

A mechanism for automatically feeding a document onto the glass platen and, after the image of the document has been copied, discharges the document. When the document is a double-sided one and copying images on both the sides of the document are required, the document conveying means inverts the document after one of the images has been copied and feeds the document again onto the glass platen.

(8) Duplex means

A mechanism which discharges a copying paper after an image has been copied on one side of the same in the single-sided document single-side copying or in the double-sided document single-side copying and, in the single-sided document double-side copying or in the double-sided document double-side copying, inverts the copying paper after an image has been copied on one side of the copying paper, and then feeds the same copying paper again to the image forming unit for copying an image on the other side of the copying paper.

(9) Mode selecting means

The mode selecting means may comprise keys arranged in the auto-reverse document feeder or in the control panel of the copying machine.

BRIEF DESCRIPTION OF THE DRAWINGS

Other objects and features of the invention will become apparent to those skilled in the art as the disclosure is made in the following description of a preferred embodiment of the invention, as illustrated in the accompanying sheets of drawings, in which:

FIGS. 8 to 13 are flow charts of subroutines to be executed in step S114 of the main routine.

DETAILED DESCRIPTION OF THE PREFERRED EMBODIMENT

The present invention will be described hereinafter with reference to a preferred embodiment thereof illustrated in the accompanying drawings.

Image Forming Unit

Figure 1:
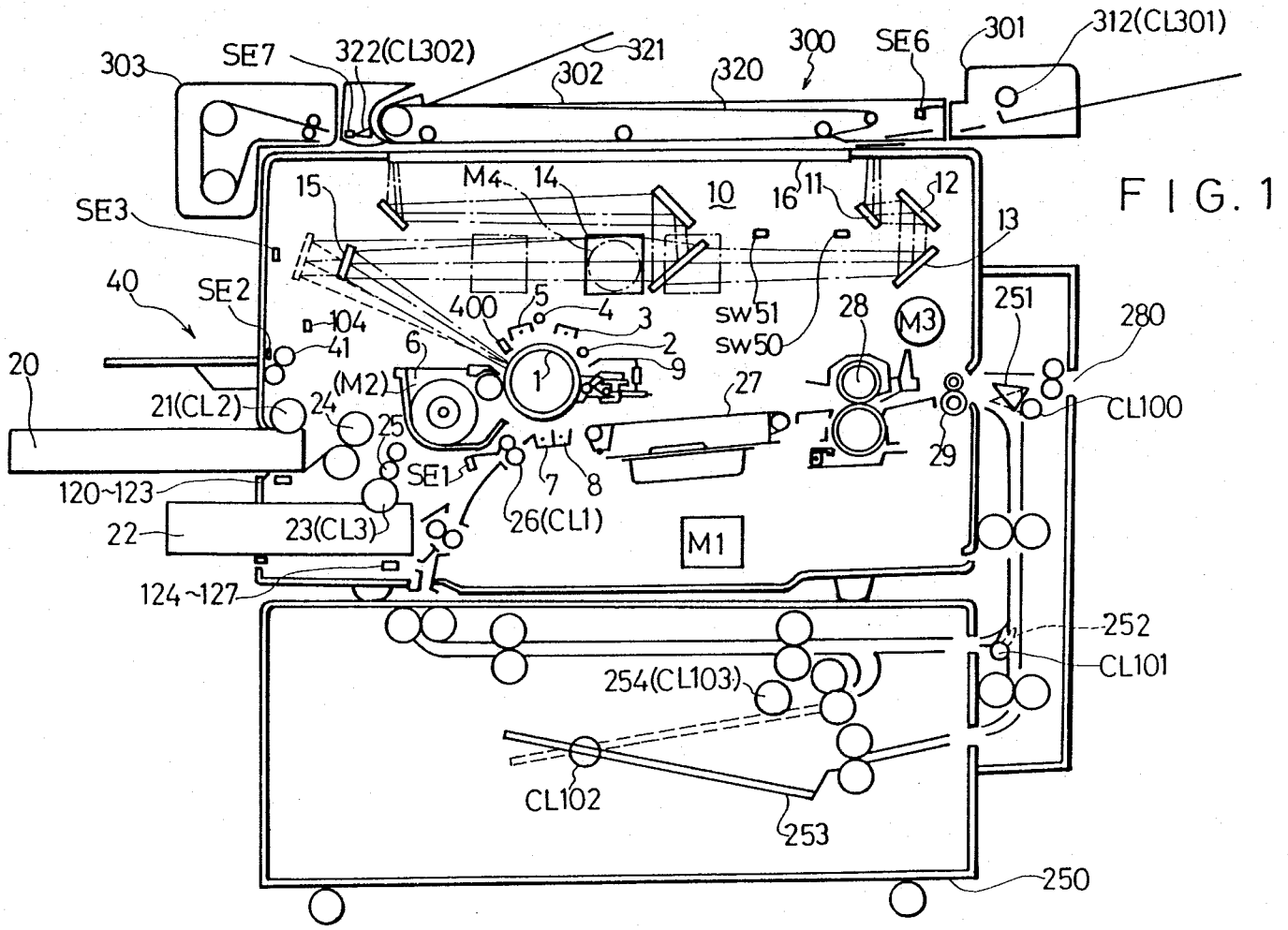
FIG. 1 is a sectional view showing the constitution of a copying machine, in a preferred embodiment, according to the present invention.

FIG. 1 is a schematic sectional view of the image forming unit of a copying machine embodying the present invention. Referring to FIG. 1, a photosensitive drum 1 is disposed substantially in the central portion of the copying unit. The photosensitive drum is driven for counterclockwise rotation. Disposed around the photosensitive drum 1 are: a main eraser lamp 2, an auxiliary charging charger 3, an auxiliary eraser lamp 4, a main charging charger 5, a selective eraser lamp 400, a developing device 6, a transfer charger 7, a separating charger 8, and a blade type cleaning device 9. The photosensitive drum 1 is provided on the circumference thereof with a photosensitive layer, which is erased and charged for sensitization by the eraser lamps 2 and 4 and the charging chargers 3 and 5, and then is exposed to an optical image focused thereon by the optical system 10.

The optical system 10 is disposed below a glass platen 16 in order to scan an image of a document placed on the glass platen 16. The optical system 10 comprises a light source, not shown, movable mirrors 11, 12, and 13, a lens 14, and a mirror 15. The light source and the movable mirror 11 are driven so as to move leftward for scanning operation at a speed v/m (v: a fixed circumferential speed of the photosensitive drum 1, m: a copying magnification) by a DC motor M3. The movable mirrors 12 and 13 are driven by the DC motor M3 for scanning operation so as to move leftward at a speed of v/2m. In order to change the copying magnification, the lens 14 is shifted along the optical path, while the mirror 15 is shifted and is caused to swing. Switches SW50 and SW51 are provided for determining the registering timing for the scanning system, respectively.

Copying paper feed units 20 and 22 respectively having feed rollers 21 and 23 are disposed in the left-hand side of the copying machine. Arranged along a copying paper conveying path are: a pair of rollers 24, a pair of rollers 25, a pair of timing rollers 26, a conveyor belt 27, a fixing device 28, and a pair of discharge rollers 29. Indicated at 120 to 123 are paper code detecting switches for detecting paper codes representing paper sizes, for the copying paper feed unit 20, while indicated at 124 to 127 are paper code detecting switches for the copying paper feed wunit 22. A paper detector SE1 for controlling the timing rollers 26 is disposed before the timing rollers 26 with respect to the copying paper feed direction.

A manual copying paper feed unit 40 is provided above the copying paper feed unit 20. A copying paper manually fed by means of the manual copying paper feed unit 40 is directed toward the rollers 24 of the copying paper feed unit 20 via a pair of rollers 41. A detector SE2 for detecting a manually fed copying paper is disposed before the rollers 41. The manual copying paper feed unit 40 folds on the body of the copying machine. A detector SE3 for detecting the positional condition of the manual copying feed unit 40 is provided on the side wall of the body.

A duplex unit 250 for double-side copying or for composite copying is disposed under the main body of the copying machine. The duplex unit 250 is provided with a discharge path changeover clutch CL100 for controlling a first changeover guide 251, and a composite copying path clutch CL101 for controlling a second changeover guide 252, to changeover the copying paper conveying path according to a selected copying mode among a normal single-side copying mode, a double-side copying mode and a composite copying mode. In the double-side copying mode, a copying paper carrying an image copied on one side thereof is stored temporarily in a temporaty storage tray 253. When a secondary copying operation start signal is given, the temporary storage tray 253 is turned by a tray control clutch CL102 to a position indicated by broken lines, and then the copying paper stored in the temporary storge tray 253 is fed into the copying unit by a refeed roller 254. Consequently, the copying paper is inverted and the leading edge and trailing edge of the copying paper are interchanged.

On the other hand, in the composite copying mode, the composite copying path clutch CL101 is actuated so that a copying paper delivered from the image forming unit is refed directly to the image forming unit by-passing the temporary storage tray 253, and then another image is copied over the image copied in the preceding copying cycle. A copying paper discharged from the duplex unit 250 through a discharge unit 280 is delivered to a sorter, not shown.

Auto-Reverse Document Feeder

The auto-reverse document feeder 300 will be described with reference to FIGS. 1 and 2.

The auto-reverse document feeder 300 comprises a document feeding section 301, a conveying section 302, and an inverting section 303. The document feeding section 301 has a copying area indicating plate 311 and a document feed roller 312. The copying area indicating plate 311 is formed of a transparent material. Square patterns indicating copying areas, and area numbers are printed on the upper surface of the copying area indicating plate 311. The conveying section 302 is disposed over the glass platen 16. A conveyor belt 320 conveys a document and locates the document at a predetermined position on the contact glass 16. The conveying section 302 has a conveying path changeover guide 322 for changing over the document conveying path between a discharge path through which a document is discharged into a discharge tray 321, and a conveying path through which a document is delivered to the inverting section 303. Document detectors SE6 and SE7 are disposed between the document feeding section 301 and the conveyor belt 320, and between the conveying path changeover guide 322 and the inverting section 303, respectively. The conveyance of the document is controlled on the basis of signals provided by the document detectors SE6 and SE7. The inverting section 303 inverts a document and returns the inverted document to the conveying section 302. The inverting section 303 is operated for inverting a double-sided document and for edition copying.

In edition copying, a document is placed in the document feeding section 301 with the side to be copied facing up to facilitate specifying an edition copying area. Therefore, the document is conveyed with the side to be copied facing up to the inverting section 303, then the document is inverted, and then the inverted document is located on the glass platen 16.

Figure 2:
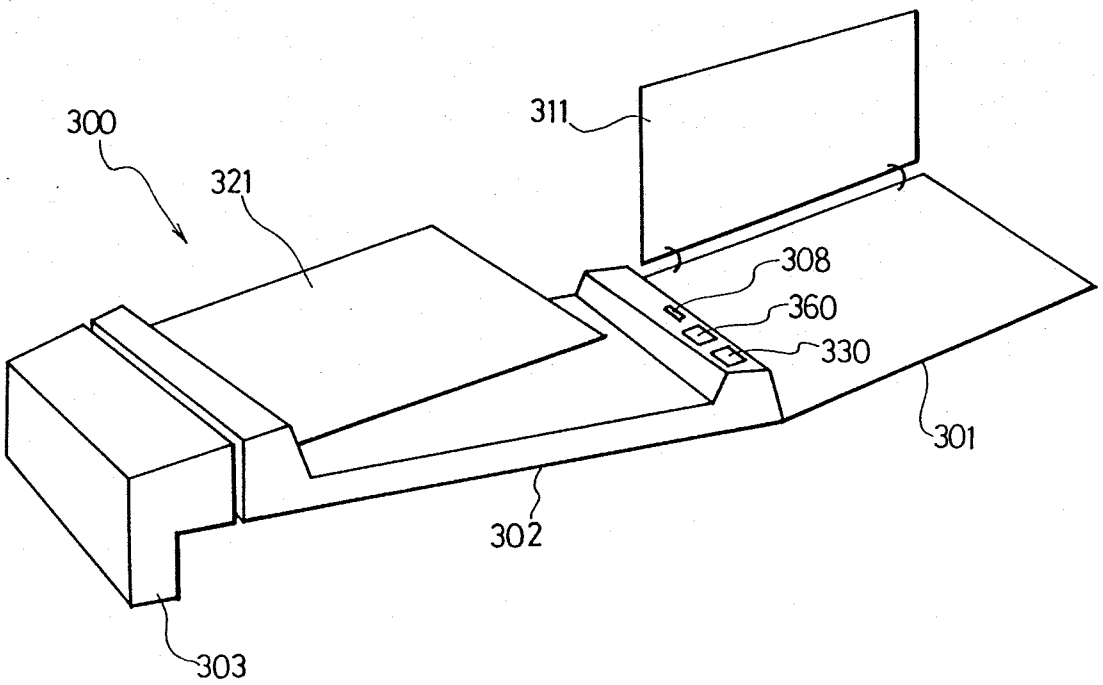
FIG. 2 is a perspective view of an auto-reverse document feeder incorporated into the copying machine in FIG. 1.

As illustrated in FIG. 2, a first control panel 330, a secon control panel 360 and a copied side indicator 380 are provided. The first control panel 330 is operated in specifying an edition copying area for document edition and copy edition. The second control panel 360 has keys for selecting various modes including the composite copying mode and for storing combinations of the copying modes, and pilot lamps.

Control Panel

Figure 3:
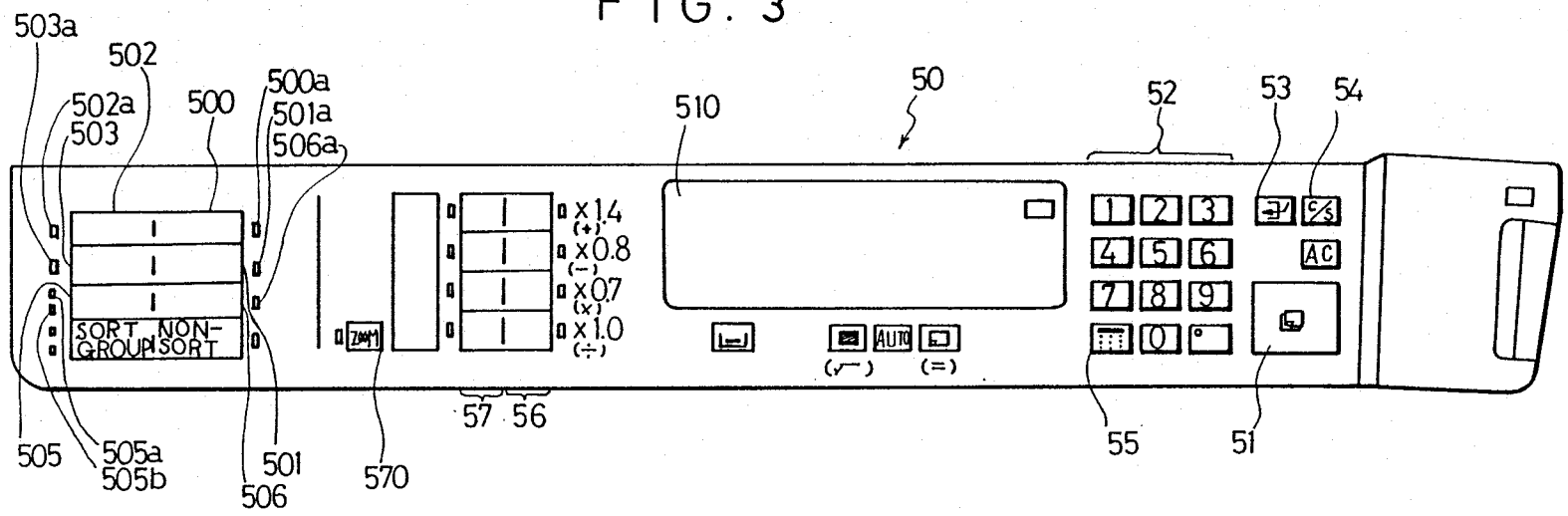
FIG. 3 is a plan view of a control panel incorporated into the copying machine of FIG. 1.

FIG. 3 illustrates an arrangement of control keys on a control panel of the copying machine. Arranged in the left-hand end of the control panel 50 are: single-sided document single-side copying mode key 500, a pilot lamp 500*a* associated with the key 500, a double-sided document single-side copying mode key 501, a pilot lamp 501*a* associated with the key 501, a single-sided document double-side copying mode key 502, a pilot-lamp 502*a* associated with the key 502, a double-sided document double-side copying mode key 503, a pilot lamp 503*a* associated with the key 503, a filing margin forming key 505, pilot lamps 505*a* and 505*b* associated with the key 505, a nonshift key 506, and a pilot lamp 506*a* associated with the key 506.

Arranged also on the control panel 50 are: a print key 51 for starting the copying machine, a display 510 for displaying the copy number and the magnification ratio in four digits, first side copying process and second side copying process, a numeric key set 52, an interrupt key 53 for instructing interrupt copying, a clear/stop key 54, a calculation mode key 55 for selecting a calculation mode, magnification setting key sets 56 and 57. The magnification setting key set 56 provides predetermined copying magnifications. The magnification setting key set 57 is provided for setting an optional magnification. When a zoom key 570 and one of the keys of the magnification setting key set 57 are operated, a value given by operating the numeric keys and displayed on the display 510 is stored in a memory corresponding to the operated key of the magnification setting key set 57 as a copying magnification.

Control Unit

Figure 4:
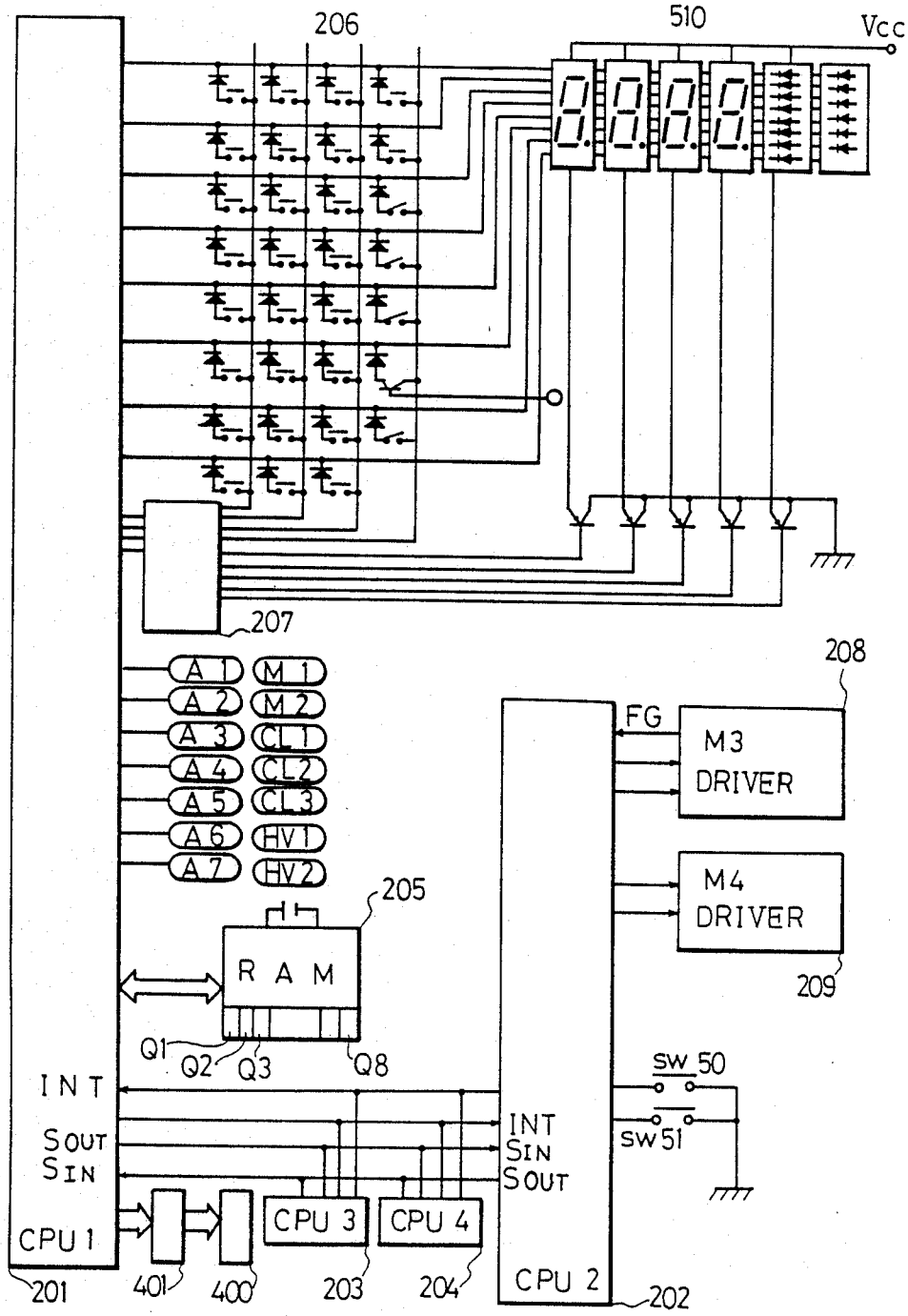
FIG. 4 is a block diagram showing the constitution of a control unit incorporated into the copying machine of FIG. 1.

FIG. 4 is a circuit diagram of a control unit incorporated into the copying machine according to the present invention. A second CPU 202, a third CPU 203 and a fourth CPU 204 are connected to the interrupt terminal INT, data input terminal $S_{IN}$ and data output terminal $S_{OUT}$ of the first CPU 201.

The first CPU 201 gives a signal to a selective eraser controller 401 to control the selective eraser 400. Indicated at 205 is a RAM backed up by a battery, at 206 is a switch matrix, and at 207 is a decoder. The output terminals A1 to A7 of the first CPU 201 are connected to switching transistors, not shown, for a main motor M1, a developing motor M2, a timing roller clutch Cl1, an upper feed roller clutch CL2, a lower feed roller clutch CL3, the main charging charger 5, and the transfer charger 7, respectively.

Data for controlling the copying operation or those shifted from the ROM of the CPU 201 are stored in the RAM 205. The RAM 205 has memories Q1, Q2, Q3 and Q4 corresponding to the magnification setting key set 57, and memories Q5, Q6, Q7 and Q8 corresponding to the magnification setting key set 56.

The second CPU 202 controls the optical system 10. Connected to the second CPU 202 are: a driving circuit 200 for driving the DC motor for document scanning, a driving circuit 209 for driving a stepping motor M4 for varying the magnification, and the switches 50 and 51 disposed in the scanning path of the optical system so as to be actuated by the optical system.

The third CPU 203 controls the auto-reverse document feeder 300. The third CPU 203 has input terminals connected to the document detectors SE6 and SE7 for receiving signals from the document detectors SE6 and SE7, and output terminals connected to a document feeding clutch CL301, a driving motor, a discharge/inversion changeover clutch CL302 and the copied side indicator 308 for giving signals to the same.

The fourth CPU 204 controls the duplex unit 250. The fourth CPU 204 has output terminals connected to the discharge path changeover clutch CL100, the composite copying path clutch CL101, the tray control clutch Cl102, a refeed clutch CL103 and the driving motor of the duplex unit.

Operation

The manner of operation of the copying machine will be described with reference to flow charts shown in the accompanying drawings.

(A) Main Routine

Figure 5:
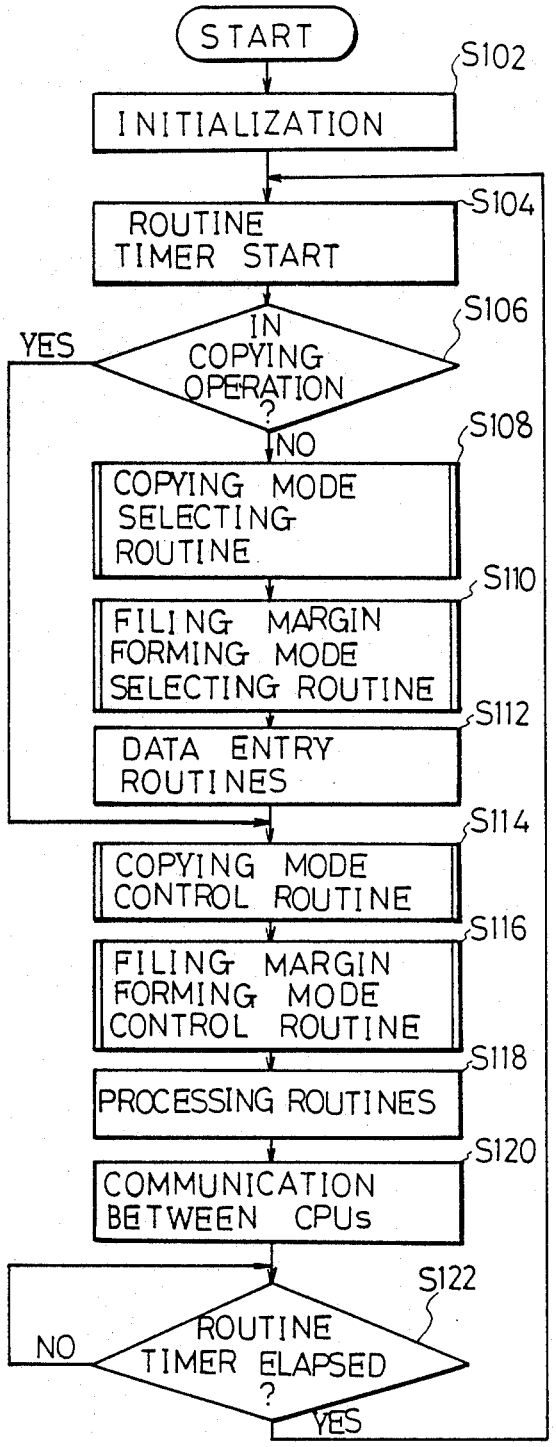
FIG. 5 is a flow chart of a main routine to be executed by the control unit of the copying machine of FIG. 1.

FIG. 5 shows a main routine to be executed by the control unit.

Referring to FIG. 5, the copying machine is connected to a power source to start the copying operation and the control unit is initialized at step S102, and then a routine timer for determining the cycle time of the routine is set at step S104. Then a decision is made at step S106 as to whether or not the copying machine is in the copying operation. Then, subroutines are executed at steps S108 to S122. The following operations are carried out at steps S108 to S122; the details of the subroutines will be described later.

(1) S108

The type of the document, namely, a double-sided document or a single-sided document, and the copying mode, namely, the double-side copying mode or the single-side copying mode, are given by operating the input keys 500, 501, 502 and 503. One of the four copying modes, namely, the single-side document single-side copying mode (mode code: 0, key: 500), the double-sided document single-side copying mode (mode code: 1, key: 501), the single-sided document double-side copying mode (mode code: 2, key: 502) and the double-sided document double-side copying mode (mode code: 3, key: 503).

(2) S110

The filing margin adjusting mode, the variable magnification shift mode or the normal copying mode is selected by operating the input keys 505 and 506.

In the filing margin adjusting mode, a document having a filing margin is copied with the filing margin in a correct side of a copying paper.

In the variable magnification shift mode, the original image on a document is reduced in size by a magnification of 0.9 to 0.95 so that any portion of the image will not be missed out of the copying paper, and the copied image is shifted toward one side of the copying paper to provide a filing margin.

In the normal copying mode (nonshift mode), the image on a document is copied as is without being shifted.

(3) S112

Input signals given to the control unit by operating the keys, such as the numeric keys and the magnification setting key, are processed. Since the subroutine of the step S112 is a well-known one, the description thereof will be omitted.

(4) S114

The document feeding operation, the copying paper feeding operation and the image forming operation are controlled so as to meet the copying mode selected at step S108.

The third CPU 203 controls the auto-reverse document feeder 300 for controlling the document feeding operation, while the fourth CPU 204 controls the duplex unit 250 for controlling the copying paper feeding operation.

(5) S116

The control for forming a correct filing margin is executed to meet the mode selected at step S110. When the filing margin adjusting (forming) mode is selected, the timing of engagement of the clutch (CL1) for the timing roller 26 is controlled. When the variable magnification shift mode is selected, the lens 14 and mirror 15 of the optical system 10 and the timing of engagement of the clutch (CL1) for the timing roller 26 through the second CPU 202 are controlled.

(6) S118

Temperature regulation, the reception of signals from the detectors, the exposure and scanning operation under the control of the second CPU 202 are executed, and so on. Since this subroutine is a well-known one, the description thereof will be omitted.

(7) S120

Communications between the four CPUs are executed.

(8) S122

A decision is made as to whether or not the time determined by the routine timer at step S104 has elapsed. When the decision is YES, the routine returns to step S104.

(B) Subroutines

Figure 6:
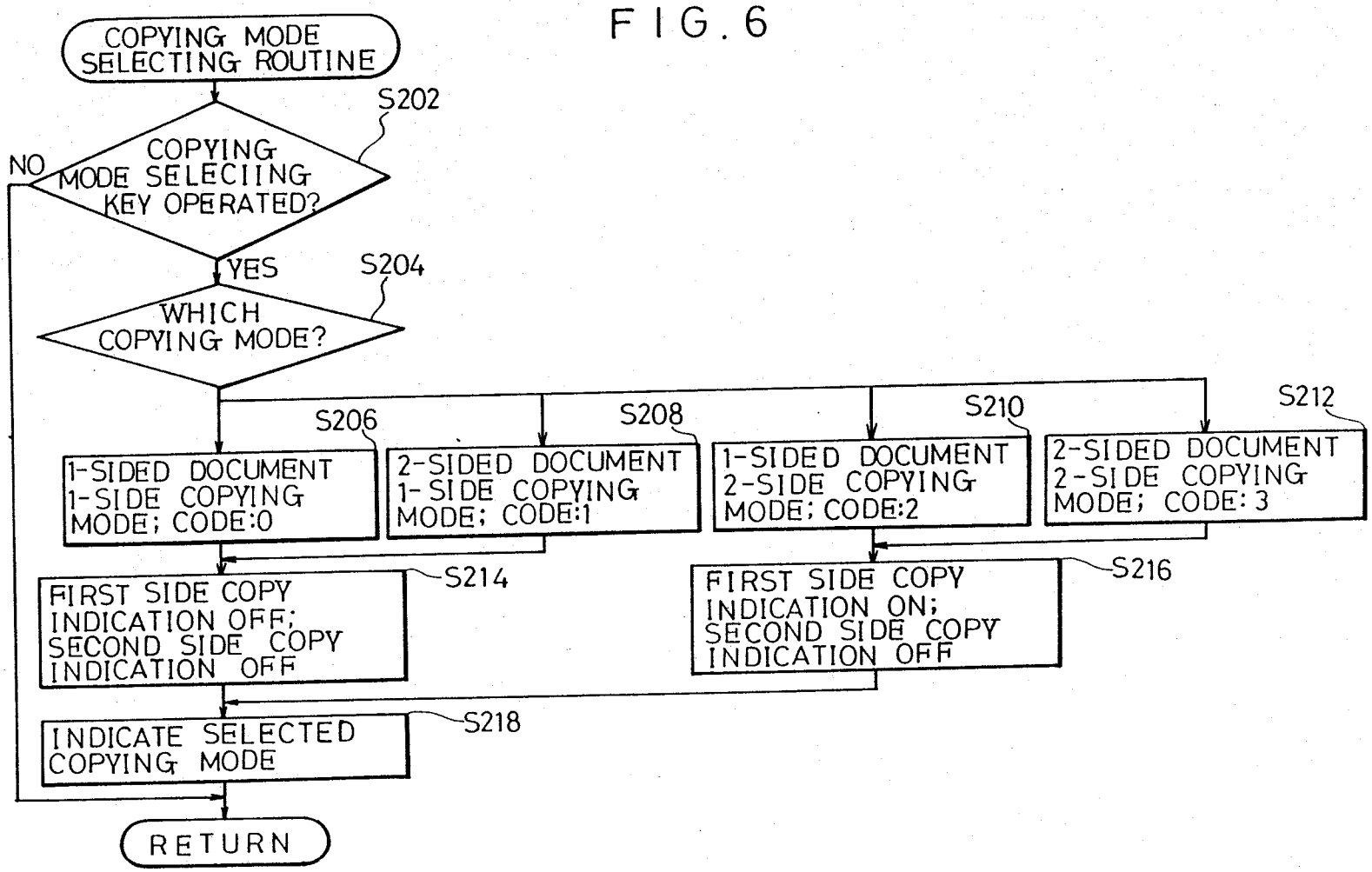
FIG. 6 is a flow chart of a subroutine to be executed to step S110 of the main routine.

1. Copying mode selecting routine (S108, FIG. 6):

A decision is made at step S202 as to whether or not a key input specifying the type of a document and the copying mode is given. When the decision is YES, the contents of the key input is determined at step S204.

When the input is given by operating the key 500 (single-sided document single-side copying mode), a mode code 0 is given at step S206; when the input is given by operating the key 501 (double-sided document single-side copying mode), a mode code 1 is given at step S208; when the input is given by operating the key 502 (single-sided document double-side copying mode), a mode code 2 is given at step S210; when the input is given by operating the key 503 (double-sided document double-side copying mode), a mode code 3 is given at step S212.

When step S206 or S200 is selected, the routine goes to step S214, where a first side copy indication and a second side copy indication displayed on the display 510 are removed, and then the routine advances to step S218 to turn on the pilot lamp 500a for the mode code 0 or the pilot lamp 501a for the mode code 1.

When step S210 or S212 is selected, the routine goes to step S216, where the first side copy indication is displayed on and the second side copy indication is removed from the display 510, and then the routine advances to step S218 to turn on the pilot lamp 502a for the mode code 2 or the pilot lamp 503a for the mode code 3.

Figure 7:
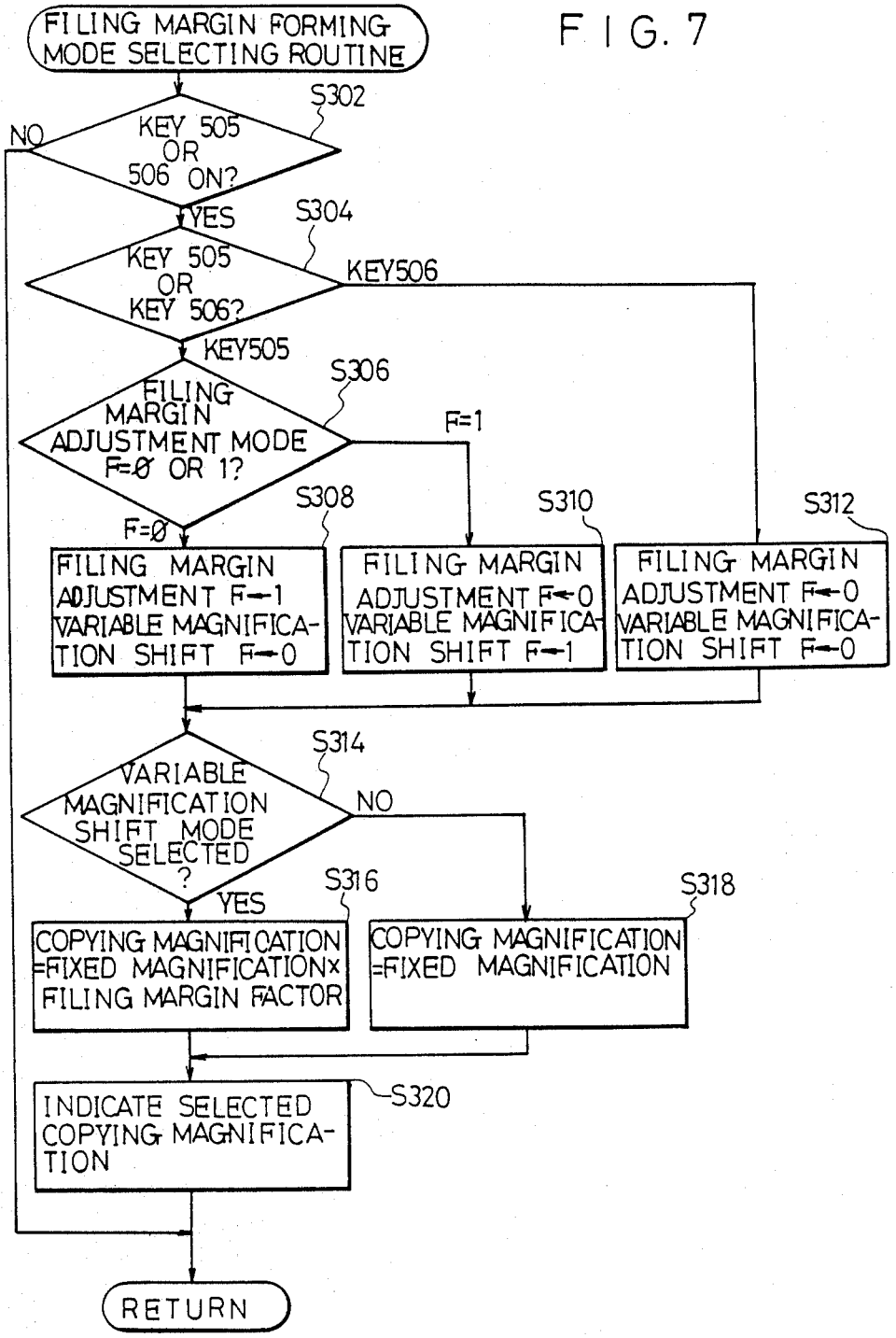
FIG. 7 is a flow chart of a subroutine to be executed at step S110 of the main routine.
Figure 8:
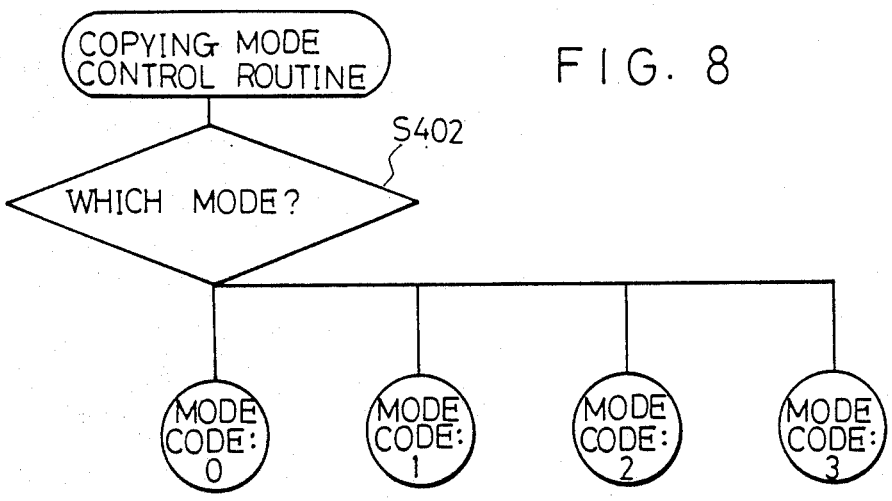

2. Filing margin forming mode selecting routine (S110, FIG. 7):

A decision is made at step S302 as to whether or not the filing margin formed key 505 or the nonshift key 506 is operated. Then, a decision is made at step S304 as to whether the operated key is the key 505 or the key 506.

When the nonshift key 506 is operated, the routine advances to step S312 to remove a filing margin adjustment flag and a variable magnification shift flag, and then the routine advances to step S314.

When the filing margin forming key 505 is operated, the filing margin adjustment flag is determined at step S306. When the filing margin adjustement flag is 1 (one), namely, when the filing margin forming mode had been established before the key 505 is operated, the routine advances the step S310 to change the filing margin adjusting mode for the variable magnification shift mode, and then the routine advances to step S314, where a decision is made as to whether or not the current mode is the variable magnification shift mode.

When the current mode is in the variable magnification shift mode, at step S316, the keys of the magnification setting key sets 56 and 57 are operated to set a copying magnification by multiplying a predetermined magnification, ordinarily, an equivalent magnification, by a predetermined filing margin factor in the range of 0.9 to 0.95, and then the routine advances to step S320.

When the decision at step S314 is NO, the routine goes to step S318 to employ a predetermined magnification, ordinarily, an equivalent magnification, set by means of the magnification setting key sets 56 and 57 as the copying magnification.

At step S320, the selected copying mode is indicated. When the selected copying mode is the filing margin adjusting mode, the variable magnification shift mode or the nonshift mode, the pilot lamp 505a, 505b or 506a, respectively, is turned on.

3. Copying mode control routine (S114, FIGS. 8 to 13):

At step S402, the mode code set at step S206, S208, S210 or S212 is determined.

Figure 9:
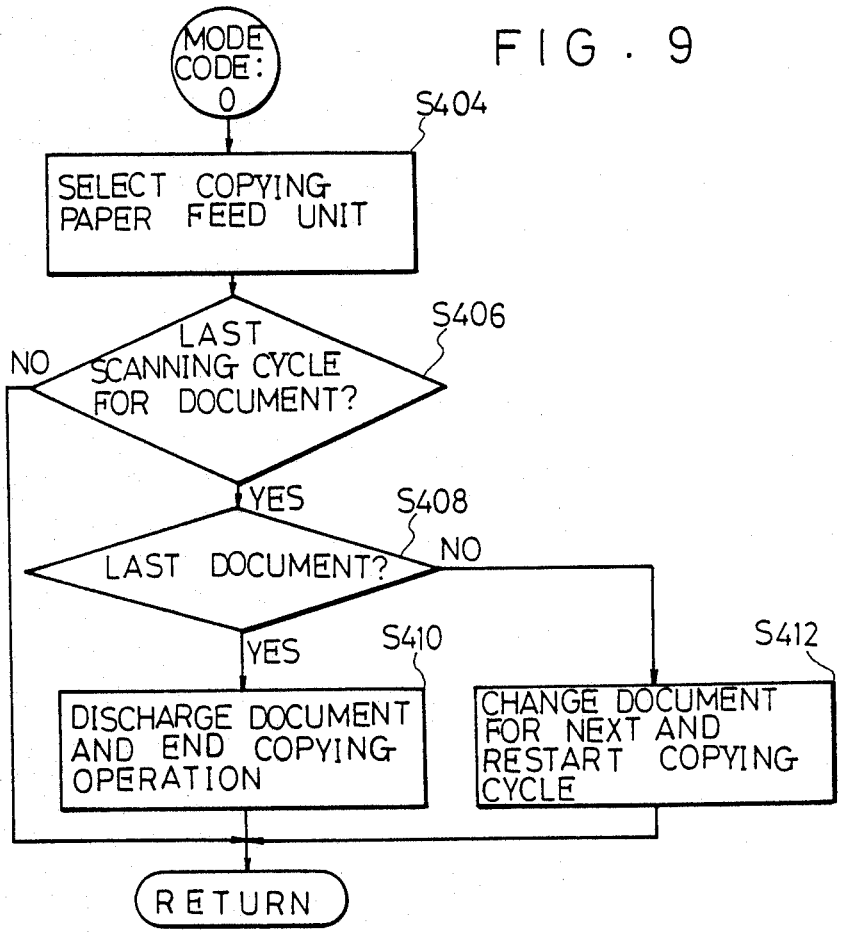

(1) Mode code=0 (FIG. 9)

The routine goes to step S404, where the copying paper feed unit 20, the copying paper feed unit 22 or the manual copying paper feed unit 40 is selected to feed a copying paper from an external copying paper supply source instead of the duplex unit 250.

Then, a decision is made at step S406 if the last scanning cycle of a multiple copying operation has been completed. When the decision is YES, namely, when scanning cycles for producing a plurality of copies of a document have been completed, a decision is made at step S408 if the last document among a plurality of documents fed by the auto-reverse document feeder 300 has been fed. When the decision at step S408 is YES, the last document is discharged to the discharge tray 321 to end the copying operation. When the decision at step S408 is NO, the routine goes to step S412 to feed the next document and to restart the copying cycle.

Figure 10:
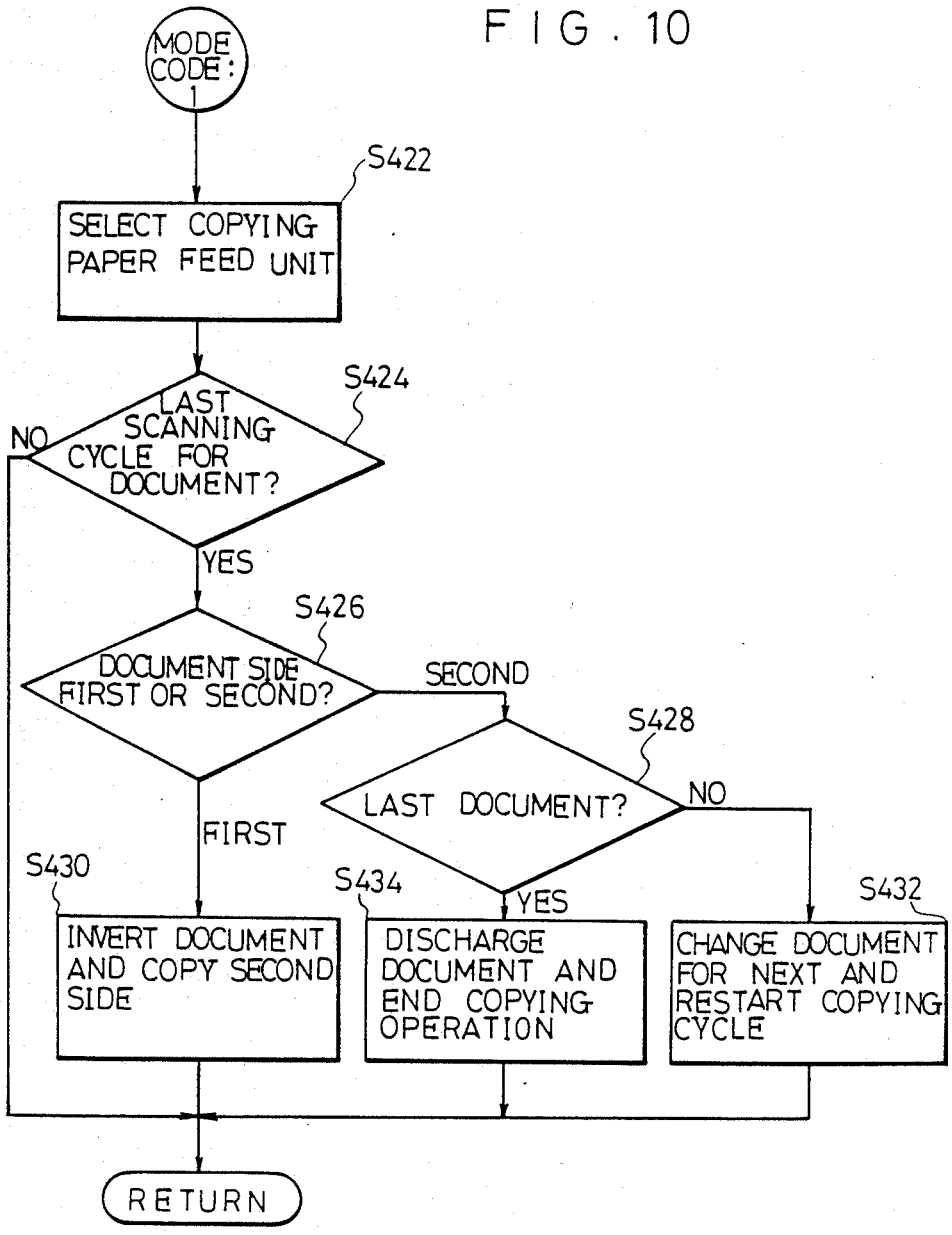

(2) Mode code=1 (FIG. 10)

The routine goes to step S422. Similarly to the procedure at step S404, the copying paper feed unit 20, the copying paper feed unit 22 or the manual copying paper feed unit 40 is selected.

Then, a decision is made at step S424 if the last scanning cycle of a multiple copying operation has been completed. When the decision at step S424 is YES, the routine goes to step S426, where a decision is made as to whether the side facing the glass platen of the document, namely, the currently scanned side of the document is the first side or the second side of the document. When the side facing the glass platen is the first side, the routine goes to step S430 to invert the document by the inverting section 303 of the auto-reverse document feeder 300 and to start copying the second side of the document. When the side facing the glass platen is the second side, a decision is made at step S428 if the document fed by the auto-reverse document feeder 300 is the last document. When the decision at step S428 is YES, the routine goes to step S434 to discharge the document to the discharge tray 321 and to end the copying operation. When the decision at step S428 is NO, the routine goes to step S432 to change the document and to rtestart the copying cycle.

(3) Mode code=2 (FIG. 11)

The routine goes to step S442, where a decision is made as to whether the copying side indication indicates the first side or the second side of a copying paper, namely, whether the document is to be copied on the first side or the second side of a copying paper. When the image is to be copied on the first side of a copying paper, the copying paper feed unit 20, the copying paper feed unit 22 or the manual copying feed unit 40 is selected at step S444, and the clutch CL100 is controlled at step 446 to connect the conveying path to the temporary storage tray 253, whereby the copying paper is delivered to the duplex unit 250.

When the document is to be copied on the second side of a copying paper, the clutches Cl102 and CL103 are controlled at step S448 so that a copying paper is fed by the duplux unit 250, and then the clutch CL100 is controlled at step S450 to connect the conveying path to the normal path, whereby the copying paper is discharged through the discharge unit 280.

Then, at step S452, a decision is made as to whether or not the last scanning cycle of a multiple copying operation has been completed. When the decision at step S452 is YES, namely, all the scanning cycles for producing a plurality of copies of a document have been completed, a decision is made at step S454 if the document fed by the auto-reverse document feeder 300 is the last document. When the decision at step S454 is YES, the document is discharged to the discharge tray 321 and the copying operation is ended. If the last document is copied on the first side of a copying paper, namely, when the copying paper carries an image only on one side thereof (S458), the copying paper is delivered from the temporary storage tray 253 to the discharge unit without copying and discharged from the discharge unit 280 at step S460, and then, at step S462, the first side copy indication is turned on and the second side copy indication is turned off. When the decision at step S454 is NO, the document is changed for the next document and the next copying cycle is started at step S464. Then, a decision is made at step S466 if the first side copy indication is turned on. Then the routine goes to step S468 to turn off the first side copy indication and to turn on the second side copy indication, or step S470 to turn on the first side copy indication and to turn off the second side copy indication, according to the decision mode at step S466.

Figure 12:
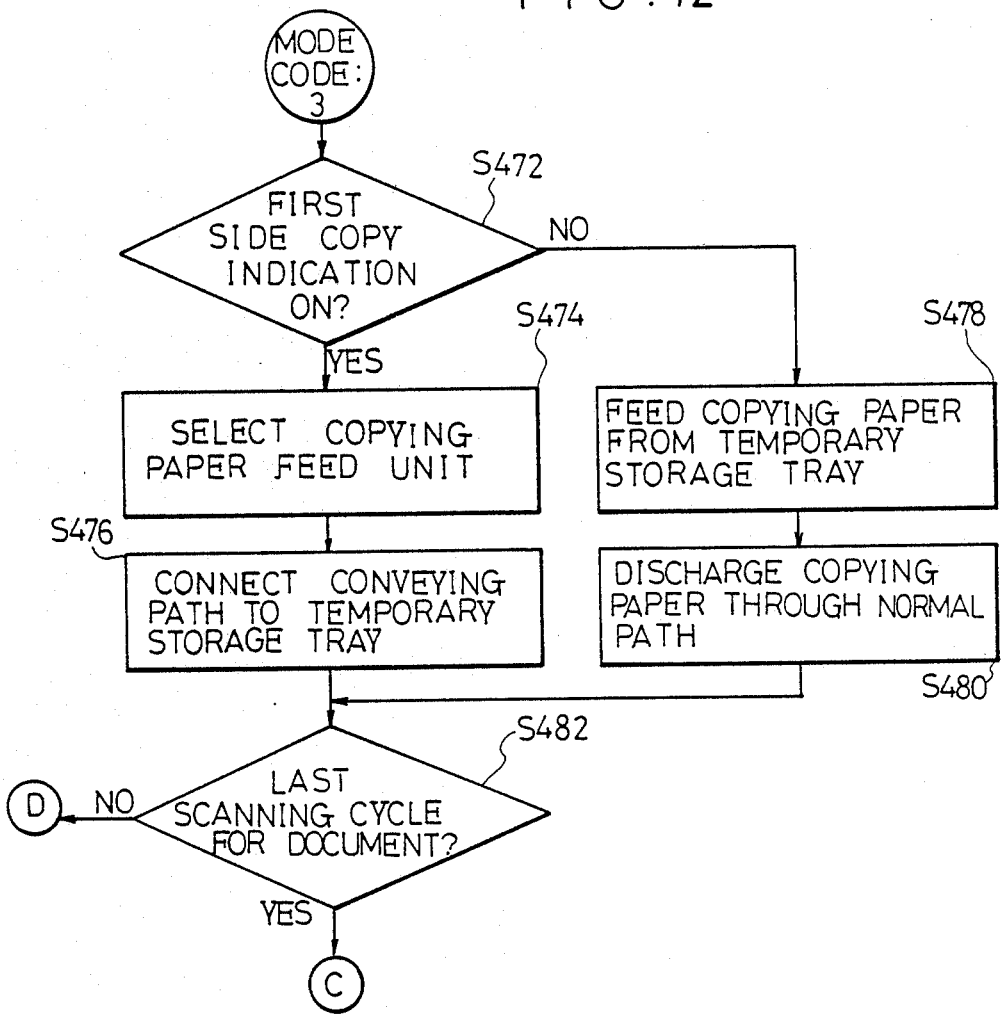
Figure 13:
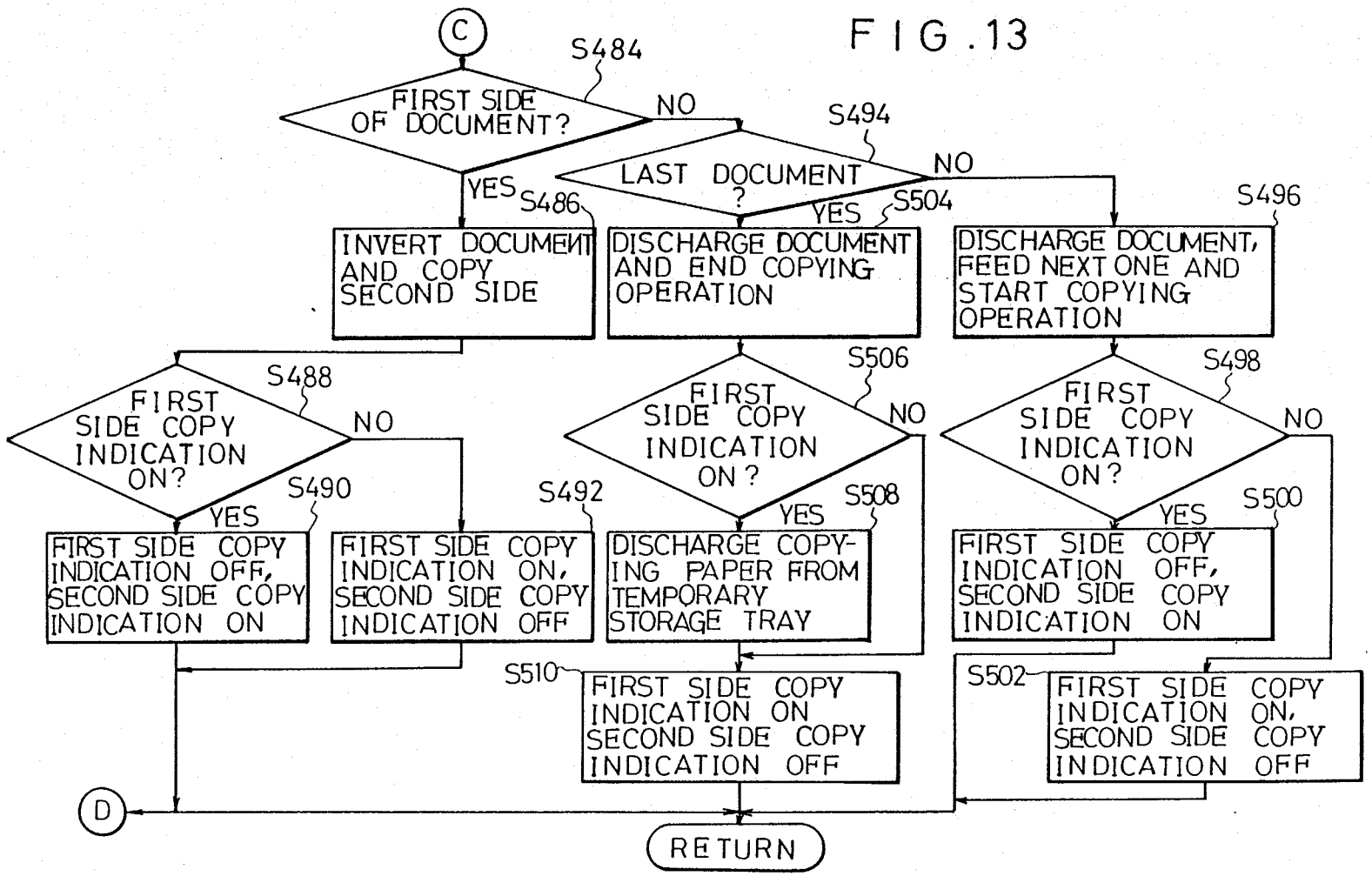

(4) Mode code=3 (FIGS. 12, 13)

The routine goes to step S472 to decide whether the document is to be copied on the first side of a copying paper or to be copied on the second side of the same. When the document is to be copied on the first side of a copying paper, the copying feed unit 20, the copying paper feed unit 22 or the manual copying paper feed unit 40 is selected at step S474, and then the clutch CL100 is controlled at step S476 so that the copying paper is delivered to the duplex unit 250. When the document is to be copied on the second side of a copying paper, the clutches CL102 and CL103 are controlled at step S478 so that the copying paper is fed from the duplex unit 250, and then, at step S480, the clutch CL100 is controlled so that the copying paper is discharged from the discharge unit 200.

Then, at step S482, a decision is made as to whether the last scanning cycle for a multiple copying operation has been completed. When the decision at step S482 is YES, namely, when all the scanning cycles for producing a plurality of a copy of a document have been completed, a decision is made at step S484 as to whether the side of the document copied in the preceding copying cycle is the first side or the second side. When the side of the document copied in the preceding copying cycle is the first side, the routine goes to step S486, where the document is inverted by the inverting section 303 of the auto-reverse document feeder 300, and then the next copying cycle for copying the second side of the document is started. Then, at step S488, a decision is made as to whether the first side copy indication is turned on or not. Then, the first side copy indication is turned off and the second side copy indication is turned on at step S490, or the first side copy indication is turned on and the second side copy indication is turned off st step S492, according to the decision made at step S488. When it is decided at step S484 that the second side of the document was copied in the preceeding copying cycle, the routine goes to step S494, where a decision is made as to whether or not the document is the last one.

When the decision at step S494 is YES, namely, document is the last one, the document is discharged to the discharge tray 321 and the copying operation is ended. When the last document is copied on the first side of a copying paper (S506), the copying paper carrying an image only on the first side thereof is delivered from the temporary storage tray 253 directly to the discharge unit 280 and is discharged from the discharge unit 280 at step S508, and then, at step S510, the first side copy indication is turned on and the second side copy indication is turned off.

When the decision at step S494 is NO, the document is changed for the next one and the next copying cycle is started at step S496. Then, a decision is made at step S498 as to whether or not the first side copy indication is turned on. Then, the first side copy indication is turned off and the second side copy indication is turned on at step S500, or the first side copy indication is turned on and the second side copy indication is turned off at step S502, according to the decision made at step S498.

Figure 14:
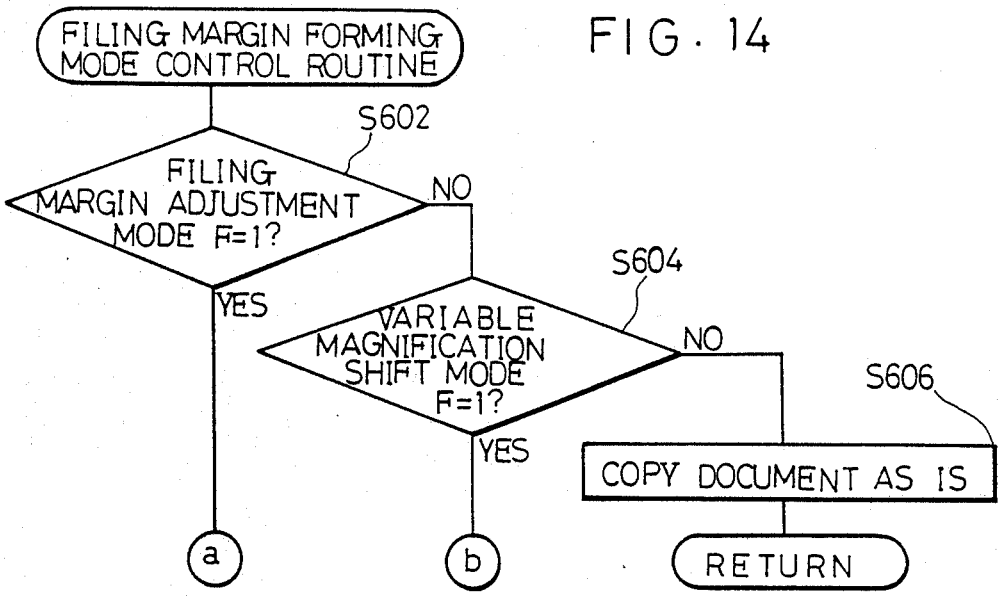
FIGS. 14 to 22 are flow charts of subroutines to be executed at step S116 of the main routine.
Figure 15:
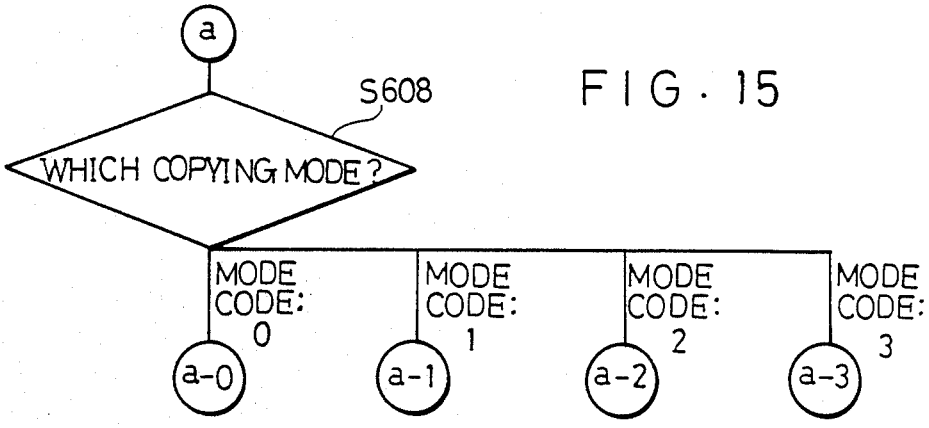

4. Filing margin forming mode control routine (S116, FIGS. 14 to 22):

Referrring to FIGS. 14 and 15, a decision is made at step S602 as to whether or not the filing margin adjusting mode is selected. When the decision at step S602 is YES, the mode code of the current copy mode is determined at step S608.

Figure 17:
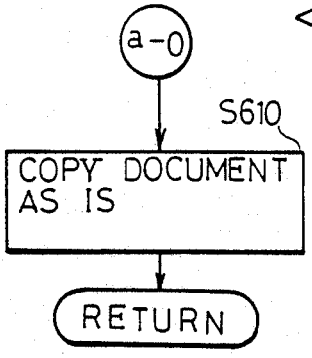

(1) Mode code=0 (FIG. 17)

The routine goes to step S610 for the normal copying operation.

Figure 18:
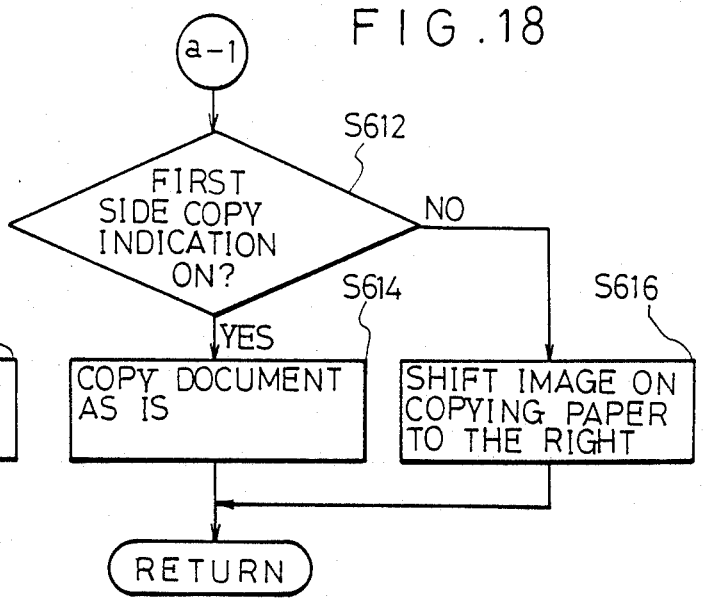

(2) Mode code=1 (FIG. 18)

The routine goes to step S612, where a decision is made as to whether or not the first side copy indication is turned on. When the decision at step S612 is YES, the routine goes to step S614 for the normal copying operation. When the decision at step S612 is NO, the routine goes to step S616, where the image on the document is shifted in an appropriate direction (the direction to the right in the embodiment) by a distance corresponding to a filing margin and is copied on a copying paper.

Figure 19:
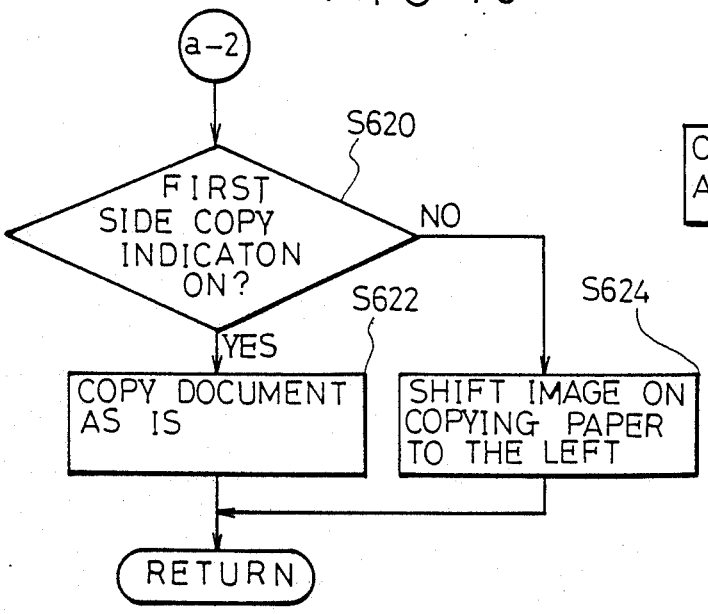

(3) Mode code=2 (FIG. 19)

The routine goes to step S620, where a decision is made as to whether or not the first side copy indication is turned on. When the decision at step S620 is YES, the routine goes to step S622 for the normal copying operation. When the decision at step S620 is NO, the routine goes to step S624 for the filing margin shift copying operation (shifting to the left in the embodiment).

Figure 20:
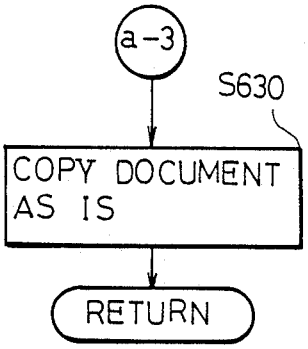

(4) Mode code=3 (FIG. 20)

The routine goes to step S630 for the normal copying operation.

Figure 16:
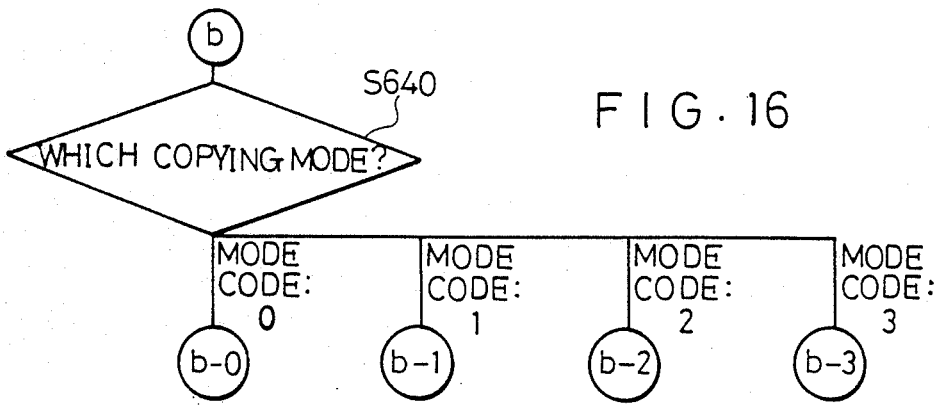

Referring to FIGS. 14 and 16, when the decision at step S602 is NO, the routine goes to step S604, where a decision is made as to whether or not the variable magnification shift mode is selected. When the decision at step S604 is YES, the routine goes to step S640, where the mode code is determined.

Figure 21:
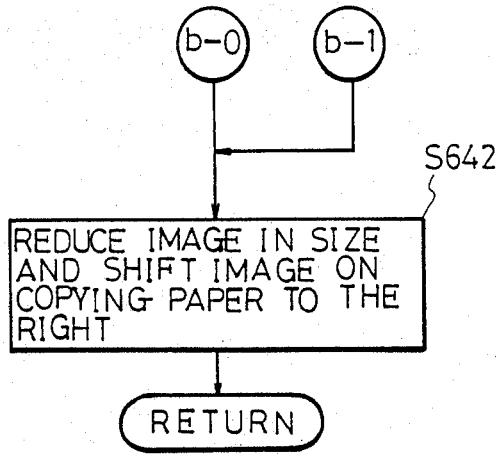

(1) Mode code=0 or 1 (FIG. 21)

The routine goes to step S642, where the image on the document is shifted in an appropriate direction (the direction to the right in the embodiment) by a distance corresponding to a filing margin and is copied on a copying paper at a copying magnification set previously at step S316.

Figure 22:
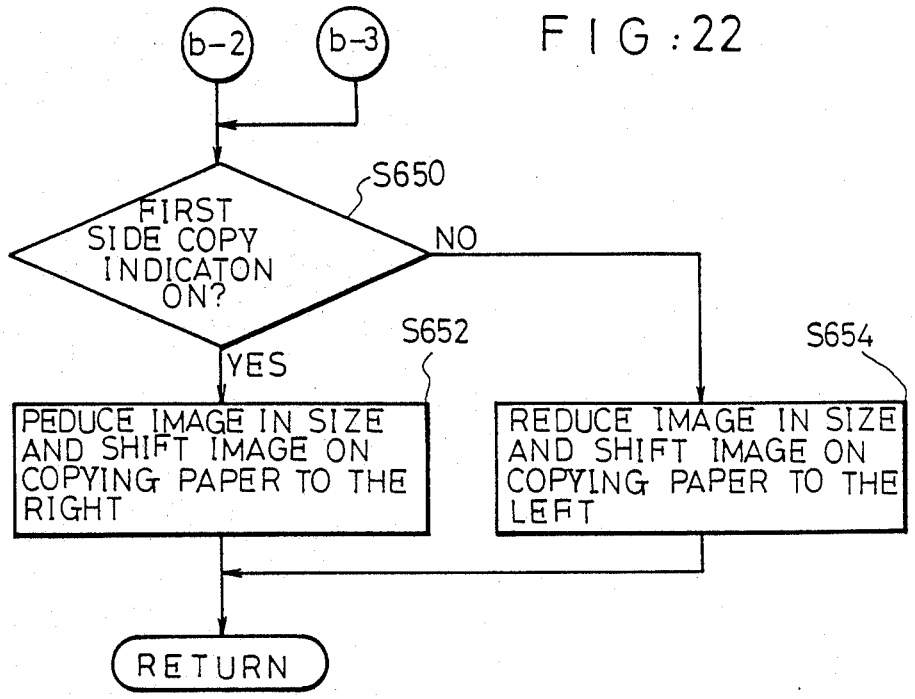

(2) Mode code=2 or 3 (FIG. 22)

The routine goes to step S650, where a decision is made as to whether or not the first side copy indication is turned on. When the decision at step S650 is YES, the document is copied on a copying paper with a filing margin in the right side of the copying paper at step S652. When the decision at step S650 is NO, the routine goes to step S654 to copy the document on the copying paper with a filing margin in the left side of the copying paper. In either case, the document is copied at a copying magnification previously set at step S316.

Thus, the copying machine according to the present invention performs the copying operation in the various coying mode.

Obviously, many modifications and variations of the present invention are possible in the light of the above teachings. It is therefore to be understood that within the scope of the appended claims, the invention may be practiced otherwise than as specifically described.

As apparent from the foregoing description, according to the embodiment of a present invention, in copying a document having a filing margin, the document can be copied with the filing margin in the correct marginal side of a copying paper by selecting the filing margin adjusting mode regardless of the copying mode, namely, the single-sided document single-side copying mode, the single-sided document double-side copying mode, the double-sided document single-side copying mode or the double-sided document double-side copying mode. Also, in copying a document without a filing margin, the document can be copied with the filing margin in the correct marginal side of a copying paper by selecting the variable magnification shift mode regardless of the type of a copying mode. Accordingly, the operator need not perform neither any difficult decision nor any troublesome operation for providing a filing margin correctly on the copying paper; the operator is required for such a purpose only to decide whether the document has a filing margin.

Therefore, for example, in copyig a double-sided document having a filing margin in the double-sided document single-side copying mode and the filing margin adjusting mode, the first side of the document is copied in the normal copying mode, and then the second side of the document can be copied by being shifted by a distance corresponding to the filing margin. Accordingly, filing margins are fromed in a first and a second copying paper in the same marginal sides, respectively.

Further, according to the embodiment of the present invention, when the variable magnification shift mode is selected in combination with the double-side copying mode, a first document and a second document are reduced in size on a copying paper, and the first document is shifted in one direction on the first side of the copying paper, while the second document is shifted in the opposite direction on the second side of the copying paper, and thereby, the first document and the second document are copied on the first side and second side of the copying paper, respectively, with the filing margins in the same marginal sides of the first side and second side of the copying paper, resectively.

In the embodiment described herein, the double-sided document single-side copying mode is selected by means of a switch. However, it is also possible to detect a double-sided document automatically by means of a photosensor or the like and to control the copying mode on the basis of the result of detection. The filing margin is provided in the reference marginal side of a copying paper in the manner of operation as described hereinbefore, in which a document is copied on the first side of a copying paper in the normal copying mode, and then another document is copied on the second side of the copying paper by shifting the image of the document by a distance corresponding to the filing margin. However, it is also possible to provide a filing margin in the opposite marginal side by copying a document on the second side of a copying paper in the normal copying mode and copying another document on the first side of the copying paper by shifting the image of the document by a distance corresponding to a filing margin.

Thus, the copying machine according to the present invention is capable of correctly providing filing margins on the copying paper requiring simple control operation.

What is claimed is:

1. A copying machine capable of producing a copy with a filing margin comprising:
   - a glass platen for supporting a document to be copied;
   - an image forming means for forming on a copying paper an image of the document placed on said glass platen, including
   - a magnification varying means for varying magnification for projecting the image on the document to the copying paper, and
   - an image shift means for shifting a transfer position of the image of the document on a copying paper with respect to the direction of conveyance of the copying paper;
   - a mode selecting means for selecting one of a filing margin adjusting mode in which a filing margin is formed by said image shift means,
   - a variable magnification shift mode in which a filing margin is formed by said image shift means and by said magnification varying means with reduced magnification, and
   - a nonshift mode in which no filing margin is formed; and
   - a control means for controlling said image forming means in accordance with a type of a document, a type of a copying paper, and the mode selected by said mode selecting means.

2. A copying machine capable of producing a copy with a filing margin according to claim 1, wherein
   - in the case of copying an image on a single-sided document to one side of a copying paper, or
   - in the case of copying images on both the sides of a double-sided document to both the sides of a single copying paper,
   - said control means controls said image forming means to copy in the nonshift mode regardless of the selection of the filing margin adjusting mode.

3. A copying machine capable of producing a copy with a filing margin according to claim 2, wherein
   - in the case where after a first document of two separate single-sided documents each having an image only one side thereof is copied on a first side of a copying paper, a second document is to be copied on a second side of the copying paper, or
   - in the case where after a first side of a double-sided document having images on both the sides thereof is copied on a first copying paper, a second side of the double-sided document is copied on a second separate copying paper, said control means controls said image forming means in said filing margin adjusting mode when the filing margin adjusting mode is selected.

4. A copying machine capable of producing a copy with a filing margin according to claim 1, wherein in the case of copying a first side and a second side of a double-sided document to both the sides of a single copying paper, or in the case of copying two single-sided documents to both the sides of a single copying paper, when said variable magnification shift mode is selected, said control means controls said image forming means so that a filing margin is formed on a predetermined marginal side of the copying paper in copying a first side of the copying paper, and a filing margin is formed on the opposite side to the predetermined marginal side in copying a second side of the copying paper.

5. A copying machine capable of producing a copy with a filing margin comprising:

a glass platen for supporting a document to be copied;

a document conveying means which conveys a single-sided document having an image on one side thereof or each side of a double-sided document having images on both the sides thereof to be in contact with said glass platen sequentially;

an image forming means for forming on a copying paper an image of the document placed in contact with said glass platen by said document conveying means, which includes an image shift means for shifting a transfer position of the image of the document on a copying paper to form a filing margin on a marginal side of the copying paper;

a mode selecting means for selecting one of a plurality of modes including a filing margin adjusting mode in which a filing margin is formed, and a nonshift mode in which no filing margin is formed; and a control means for controlling said image forming means in accordance with the mode selected by said mode selecting means, in the case where a double-sided document is conveyed by said document conveying menas, the filing margin adjusting mode is selected, and a first side of the double-sided document is to be copied, said control means controlling said image forming means to form no filing margin regardless of the selection of the filing margin adjusting mode.

6. A copying machine capable of producing a copy with a filing margin according to claim 5, wherein siad control means controls said image forming means to form a filing margin in the case where a double-sided document is conveyed by said document conveying means, the filing margin adjusting mode is selected, and a second side of the double-sided document is to be copied.

7. A copying machine capable of producing a copy with a filing margin according to claim 6, wherein said document conveying means includes a conveying member which conveys a document to be in contact with said glass platen and discharges the document from the surface of said glass platen, and an inverting member which inverts the document discharged from the surface of said glass platen and places the inverted document in contact with said glass platen.

8. A copying machine capable of producing a copy with a filing margin comprising:

a glass platen for supporting a document to be copied;

an image forming means for forming on a copying paper an image of the document placed on said glass platen, including a magnification varying means for varying magnification for projecting the image on the document to the copying paper, and an image shift means for shifting a transfer position of the image of the document to form a filing margin on a predetermined marginal side of the copying paper, a duplex means for inverting a copying paper which has a copied image on a first side and re-supplying the copying paper to said image forming means;

a mode selecting means for selecting one of a plurality of modes including a variable magnification shift mode in which the image transfer position is shifted by said image shift means and the projecting magnification is reduced by said magnification varying means, and a nonshift mode in which no filing mode is formed;

a control means for controlling said image forming means in accordance with the mode selected by said mode selecting means, in the case where the variable magnification shift mode is selected and each of both the sides of a double-sided document is to be copied by using said duplex means, said control means controlling said image forming means so that a filing margin is formed on a predetermined marginal side in copying a first side of the double-sided document and a filing margin is formed on the opposite side to the predetermined marginal side in copying a second side of the double-sided document.

9. A copying machine capable of producing a copy with a filing margin comprising:

a glass platen for supporting a document to be copied;

a document conveying means which conveys a single-sided document having an image on one side thereof or each side of a double-sided document having images on both the sides thereof to be in contact with said glass platen sequentially;

an image forming means for forming on a copying paper an image of the document placed on said glass platen, including a magnification varying means for varying magnification for projecting the image of the document to the copying paper, and an image shift means for shifting a transfer position of the image of the document to form a filing margin on a marginal side of the copying paper;

a duplex means for inverting a copying paper which has a copied image on a first side and re-supplying the inverted copying paper to said image forming means;

a first mode selecting means for selecting one of a single-sided document single-side copying mode in which an image on one side of a document is copied on one side of a copying paper, a single-sided document double-side copying mode in which images on one side of each of two single-sided documents, respectively, are copied on both the sides of a copying paper, a double-sided document single-side copying mode in which images on both the sides of a double-sided document, respectively, are copied on one side of each of two copying papers, and a double-sided document double-side copying mode in which images on both the sides of a double-sided document, respectively, are copied on both the sides of a copying paper, respectively, a second mode selecting means for selecting one of a filing margin adjusting mode in which a filing margin is formed by said image shift means, a variable magnification shift mode in which a filing margin is formed by said image shift means and the magnification for projecting the image of the document is reduced in size so that the image of the document is copied in the remaining space except the filing margin, and a nonshift mode in which no filing margin is formed; and a control means for controlling said image forming means in accordance with the combination of the modes selected by said first mode selecting means and said second mode selecting means.

10. A copying machine capable of producing a copy with a filing margin according to claim 9, wherein in the case where one of the single-sided document single-side copying mode and the double-sided document double-sided copying mode is selected by said first mode selecting means, and the filing margin adjusting mode is selected by said second mode selecting means, said control means controls said image forming means to form no filing margin in the nonshift mode regardless of the selection of the filing margin adjusting mode.

11. A copying machine capable of producing a copy with a filing margin, according to claim 9, wherein in the case where one of the single-sided document double-side copying mode and the double-sided document single-side copying mode is selected by said first mode selecting means, and the filing margin adjusting mode is selected by said second mode selecting means, said control means controls said image forming means so that copying is executed in the nonshift mode in copying a first document of two single-sided documents or a first side of the double-sided document, and copying is executed in the first filing margin forming mode in copying the second document of two single-sided documents or a second side of the double-sided document.

12. A copying machine capable of producing a copy with a filing margin according to claim 9, wherein in the case where one of the single-sided document double-side copying mode and the double-sided document double-side copying mode is selected by said first mode selecting means, and the variable magnification shift mode is selected by said second mode selecting means, said control means controls said image forming means so that a filing margin is formed on a predetermined marginal side in copying a first document of two single-sided documents or a first side of a double-sided document, and that a filing margin is formed on the opposite side to the predetermined marginal side in copying a second document of two single-sided documents or a second side of the double-sided document.

13. A copying machine capable of producing a copy with a filing margin according to claim 12, wherein in the case where the double-sided document single-side copying mode is selected by said first mode selecting means, and the variable magnification shift mode is selected by said second mode selecting means, said control means controls said image forming means so that a filing margin is formed in the same predetermined marginal side of each of two copying papers corresponding to each side of the double-sided document.

* * * * *